US006750784B2

(12) United States Patent
Jacobsen

(10) Patent No.: US 6,750,784 B2
(45) Date of Patent: Jun. 15, 2004

(54) METHOD OF LINEARIZING A SINE AND COSINE SIGNAL

(75) Inventor: Peter M. Jacobsen, Oakland Township, MI (US)

(73) Assignee: Eaton Corporation, Cleveland, OH (US)

( * ) Notice: Subject to any disclaimer, the term of this patent is extended or adjusted under 35 U.S.C. 154(b) by 372 days.

(21) Appl. No.: 09/988,463

(22) Filed: Nov. 20, 2001

(65) Prior Publication Data

US 2003/0102982 A1 Jun. 5, 2003

(51) Int. Cl.[7] ..... G08C 19/06

(52) U.S. Cl. ..... 340/870.05; 340/686.1; 340/686.3; 318/602; 324/207.11; 324/207.12; 324/207.24; 324/207.25; 341/4; 341/15

(58) Field of Search ..... 340/870.3, 870.05, 340/686.1, 686.3, 870.04; 318/439, 602, 608; 324/207.24, 207.11, 207.22, 207.25, 207.12; 341/4, 15; 250/231.13

(56) References Cited

U.S. PATENT DOCUMENTS

| | | | | | |
|---|---|---|---|---|---|
| 4,070,665 | A | | 1/1978 | Glennon et al. | 340/347 SY |
| 4,093,903 | A | | 6/1978 | Thomas | 318/584 |
| 4,395,663 | A | | 7/1983 | Manktelow et al. | 315/403 |
| 4,774,464 | A | * | 9/1988 | Kubota et al. | 324/207.25 |
| 4,984,857 | A | | 1/1991 | Yeung et al. | 350/6.6 |
| 5,235,177 | A | | 8/1993 | Hutchinson et al. | 250/225 |
| 5,373,389 | A | | 12/1994 | Huber | 359/195 |
| 5,668,455 | A | * | 9/1997 | Gotz et al. | 318/602 |
| 5,796,231 | A | * | 8/1998 | Kyodo | 318/608 |
| 6,087,654 | A | * | 7/2000 | Durham, III | 250/231.13 |
| 6,118,271 | A | * | 9/2000 | Ely et al. | 324/207.17 |
| 6,433,536 | B1 | * | 8/2002 | Yundt et al. | 324/207.22 |
| 6,539,329 | B2 | * | 3/2003 | Kato et al. | 702/151 |

* cited by examiner

*Primary Examiner*—Albert K. Wong
(74) *Attorney, Agent, or Firm*—Roger A. Johnston

(57) ABSTRACT

A rotary position transducer with a cosine and sine attenuating voltage wave output has the substantially linear portions segmented and pieced together from a predetermined set of conditions to form a continuously linearly varying voltage output.

8 Claims, 5 Drawing Sheets

METHOD OF LINEARIZING A SINE AND COSINE SIGNAL

BACKGROUND OF THE INVENTION

The present invention relates to providing a continuously variable electrical signal from a transducer indicating the relative position of an object with respect to a stationary reference. In particular, the invention relates to providing an electrical signal indicative of the angular position of a magnet disposed on the object with respect to the stationary reference. Devices of this type are particularly desirable for indicating the relative position of the magnet and the object and find application in linear and rotary position sensing devices.

It is known to provide a magneto resistive sensor for indicating the position of a magnet moving with an object; and, such a sensor is that produced by the Honeywell Corporation and bearing manufacturer designation HMC1512.

Referring to FIG. 4, the electrical output of a known sensor is shown wherein the voltage wave is plotted as a function of the rotary position θ in degrees and indicates the phase difference of 45° for the functions SIN 2θ and COS 2θ, with a period of 180° (π radians) for the voltage wave output of the transducer.

However, it has been desired to provide a rotary position transducer having a linear voltage output with respect to the rotary position of the magnet with respect to the stationary sensor. A linear output has the advantage that the output voltage may be used to drive directly an indicator such as a volt meter to give an easy-to-read indication to the user of the rotary position of the object.

BRIEF SUMMARY OF THE INVENTION

The present invention provides a method for linearizing the output of a motion detecting transducer having a dual wave form output in the form of a sine and cosine wave voltage. The linearization is accomplished by piecing together and inverting where necessary the substantially linear portion of the sine and cosine waves of the transducer output voltage. An amplifier and multiplexer function are utilized to provide an analog output of substantially linearly varying voltage as the transducer detects motion of an object moving with respect to the stationary transducer. The moving object has a magnet associated therewith; and, the change in angular bearing of the object is measured by a transducer and the transducer voltage wave form segmented and pieced together in accordance with a predetermined set of conditions for each segment as the angle of bearing changes from zero to 180°.

DETAILED DESCRIPTION OF THE INVENTION

Figure 1:
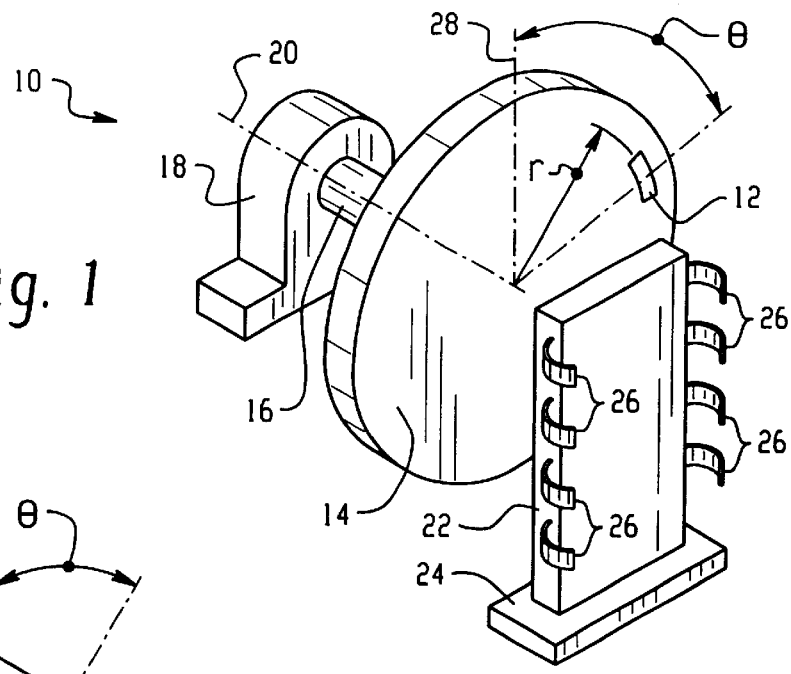
FIG. 1 is an embodiment of the present invention with a magnet mounted for rotation at a radius R about an axis fixed with respect to a sensor.

Referring to FIG. 1, a sensor arrangement employing the present invention is indicated generally at 10 and includes a magnet 12 disposed on an object 14 rotated by shaft 16 disposed in a bearing block 18 for rotation about fixed axis 20. The magnet is positioned to revolve about the axis 20 at a distance "r". A transducer or sensor 22 is mounted adjacent the object 14 on a suitable base 24 and is adapted for connection to input to appropriate signal processing circuitry, which will hereinafter be described, by means of the electrical terminals 26 provided on the sensor 22. Sensor 22 measures the angle θ with respect to the fixed reference 28.

In the present practice of the invention, a rotary position sensor manufactured by the Honeywell Corporation bearing manufacturer designation HMC1512 has been found satisfactory for the sensor 22. However, any suitable transducer having a dual sine and cosine wave form voltage output may be employed.

Figure 2:
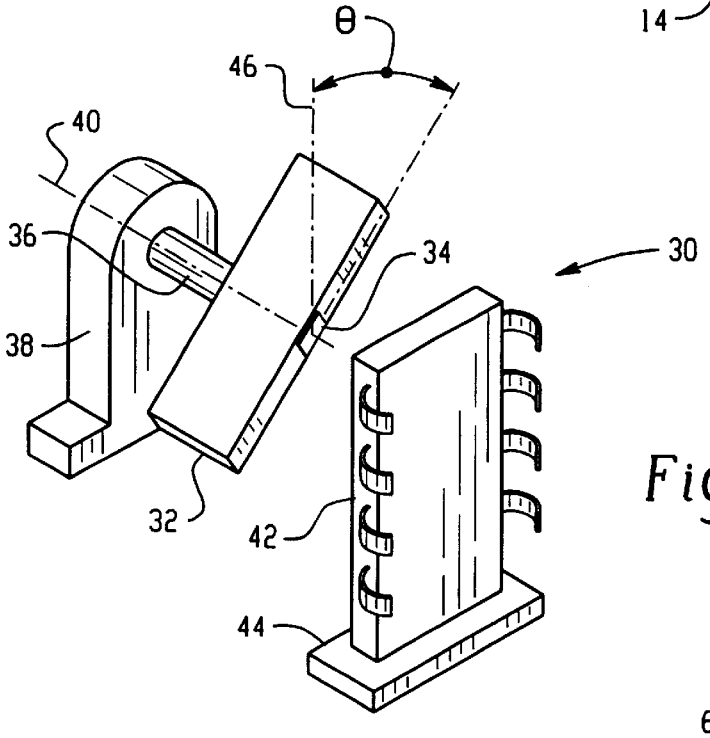
FIG. 2 is an alternate embodiment of the invention with the magnet rotating about an axis fixed with respect to the sensor and passing through the center of the magnet.

Referring to FIG. 2, an alternate embodiment of a system employing the invention is illustrated generally at 30 and has an object 32 with a magnet 34 disposed thereon for rotation on shaft 36 journalled in fixed support 38 for rotation about fixed axis 40. A sensor 42 which may be similar to the sensor 22 of the FIG. 1 embodiment is mounted adjacent the rotating magnet 34 on a suitable base 44. The magnet is denoted as subtending a central angle θ with a fixed reference 46 for purposes of correlation with the wave form signal output of sensor 42.

Figure 3:
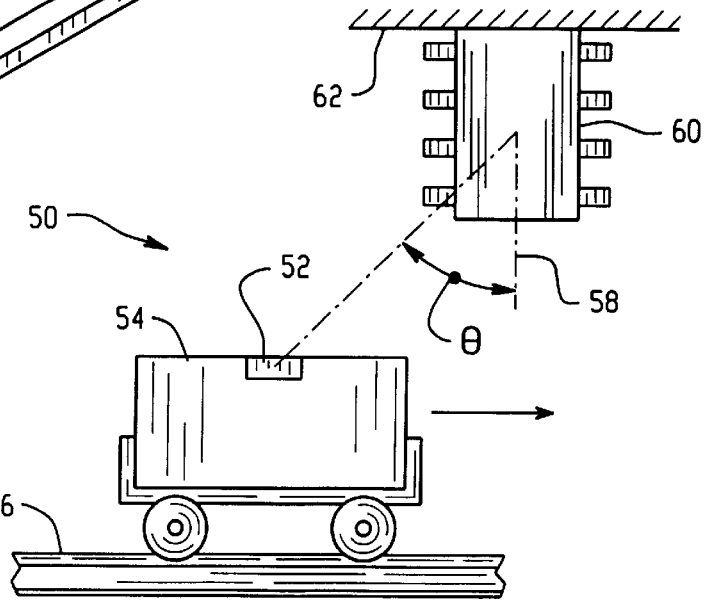
FIG. 3 is another embodiment of the invention having a magnet mounted on a trolley moving along a linear path displaced from the sensor.
Figure 4:
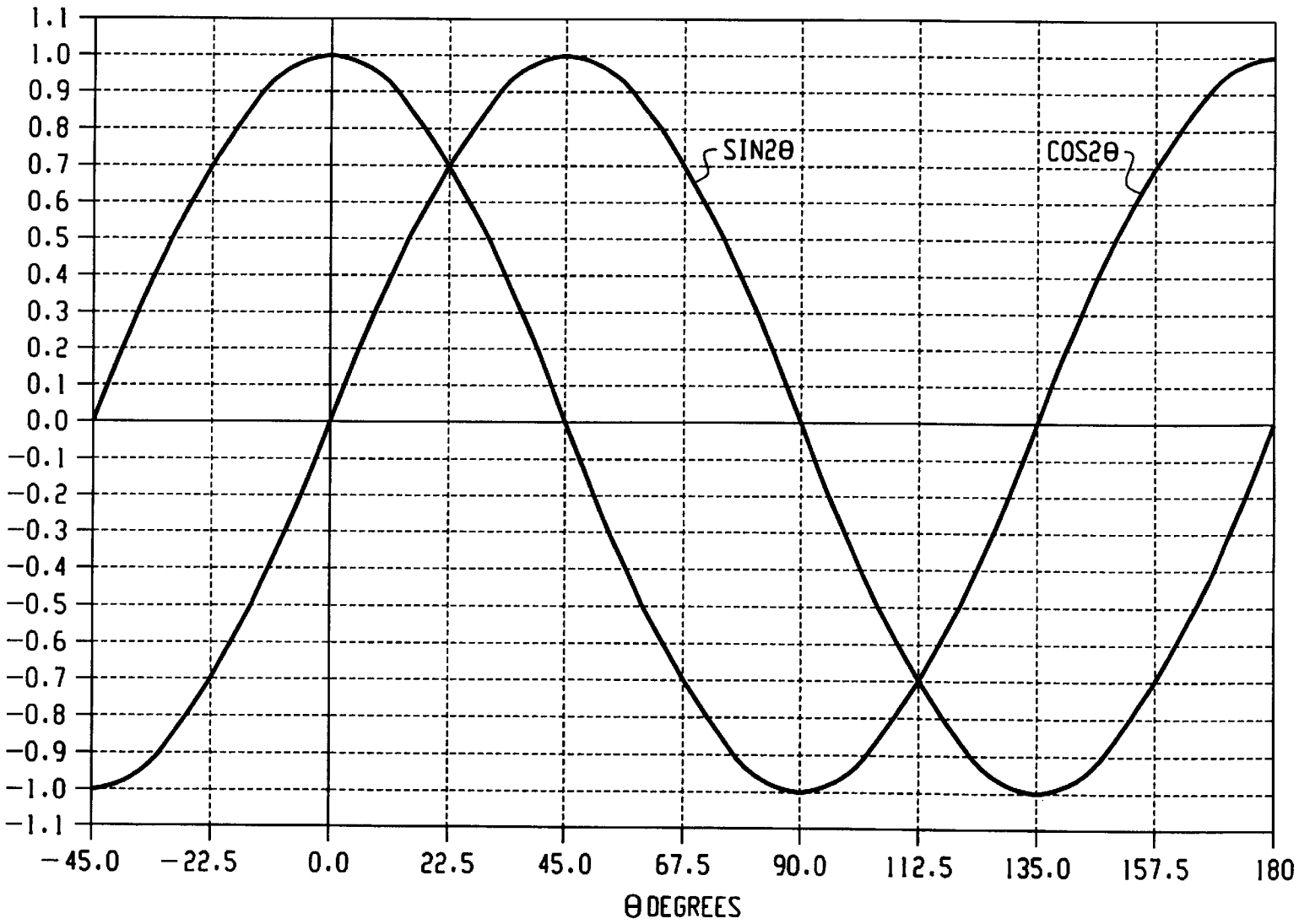
Fig. 4 PRIOR ART
FIG. 4 is a plot of voltage versus angle of rotation for a dual wave form output transducer.

Referring to FIG. 3, another embodiment of the invention is indicated generally at 50 and includes a magnet 52 disposed on a moving object 54 in the form of a trolley moving in the direction indicated by the black arrow along a surface or track 56 and subtending a central angle θ with respect to a fixed reference 58. A rotary position sensor 60 is disposed on base 62; and, in the present practice of the invention the sensor 60 is similar to the sensor 22 of FIG. 1 or the sensor 42 of FIG. 2.

Figure 5:
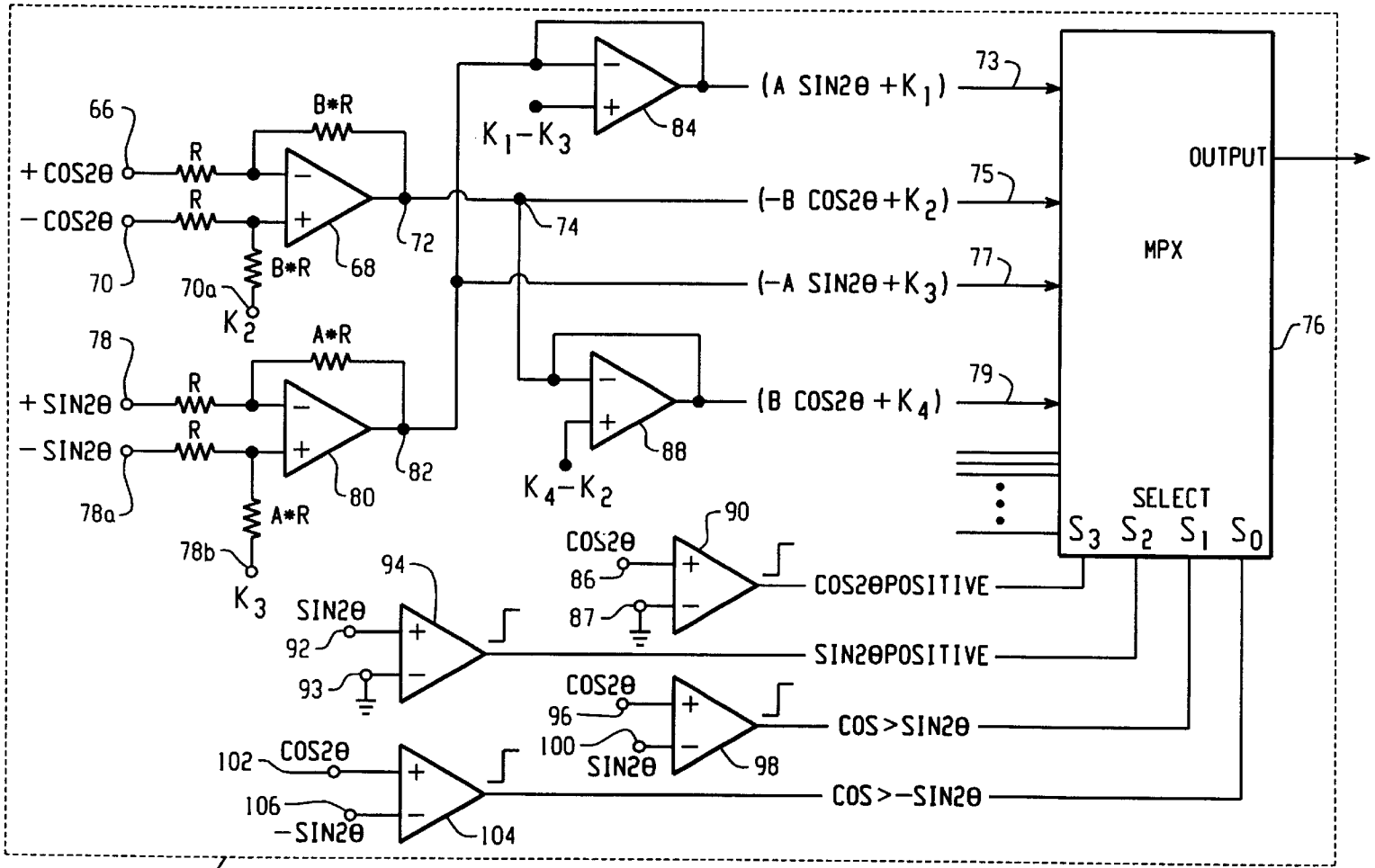
FIG. 5 is a schematic of the processing circuitry for one embodiment of the present invention.

Referring to FIG. 5, the circuit schematic of the present invention is indicated generally at 64. A COS 2θ voltage wave form from any of the sensors 22, 42, 60, is applied at terminal 66 and 70 through a resistor R to the input of an amplifier 68 with the positive terminal of the amplifier also receiving a reference voltage $K_2$ through a resistor B*R at terminal 70*a*. The output of amplifier 68 at terminal 72 is fed back to the negative input through resistor B*R thus giving the amplifier output a value of $-B \cos 2\theta + K_2$ which is applied to junction 74 and to input 75 of multiplexer 76.

The voltage wave form comprising SIN 2θ is applied to input terminal 78 and 78*a* which is connected through a resistance R to the input of an amplifier 80; and, the positive input of amplifier 80 also receives a reference voltage $K_3$ through input terminal 78*b* and resistance A*R. The output of amplifier 80 is connected to junction 82 and is fed back through resistance A*R to the negative input of the amplifier 80. Junction 82 is also connected to the negative input of amplifier 84 which has a positive input thereof receiving a reference voltage $K_1-K_3$. The output of amplifier 84 is fed back to the negative input thereof and is connected to an additional input 73 of the multiplexer 76 and provides an output signal in the form of $A \sin 2\theta + K_1$.

Junction 82 is also connected to a separate input 77 of the multiplexer 76 and provides the inverted signal $-A \text{ SIN } 2\theta+K_3$ to input 77. Junction 74 is also connected to the negative input of an amplifier 88 which has the positive input thereof connected to receive input reference voltage $K_4-K_2$ and the output thereof fed back to the negative input with the output in the form of $B \text{ COS } 2\theta+K_4$ applied to input 79 of the multiplexer 76.

The wave form voltage COS 2θ is applied to the positive input terminal 86 of amplifier 90 which has its negative input 87 grounded and thus provides output only when the input wave is positive to a select input $S_3$ of the multiplexer 76.

Similarly, the SIN 2θ is applied through input terminal 92 to the positive input of an amplifier 94 which has its negative input 93 grounded with the output only when the input sine wave form is positive and which is applied through select input $S_2$ of the multiplexer 76. It will be understood that the reference voltage at the negative input terminal 86 of amplifier 90 and at the negative terminal 93 of amplifier 94 can also be established at a valve other than ground, depending on the supply voltage used. In the present practice of the invention, a supply of 5 VDC is used and the reference voltage is 2.5 V.

The sensor wave form COS 2θ is also applied to terminal 96 which is the positive input of an amplifier 98 which has the negative input thereof connected through terminal 100 to receive the sensor wave form SIN 2θ; and, amplifier 98 provides an output only when the magnitude of the cosine wave form is greater than that of the sine wave form and provides the input to select terminal $S_1$ of multiplexer 76.

The voltage wave form for COS 2θ from the sensor is also applied to input terminal 102 which is connected to the positive input of amplifier 104 which receives through terminal 106 at its negative input a voltage wave form for −SIN 2θ from the sensor; and, the amplifier 104 provides an output only when the magnitude of the cosine wave form is greater than that of the negative sine wave form and the output is applied to select input $S_0$ of multiplexer 76.

Figure 6:
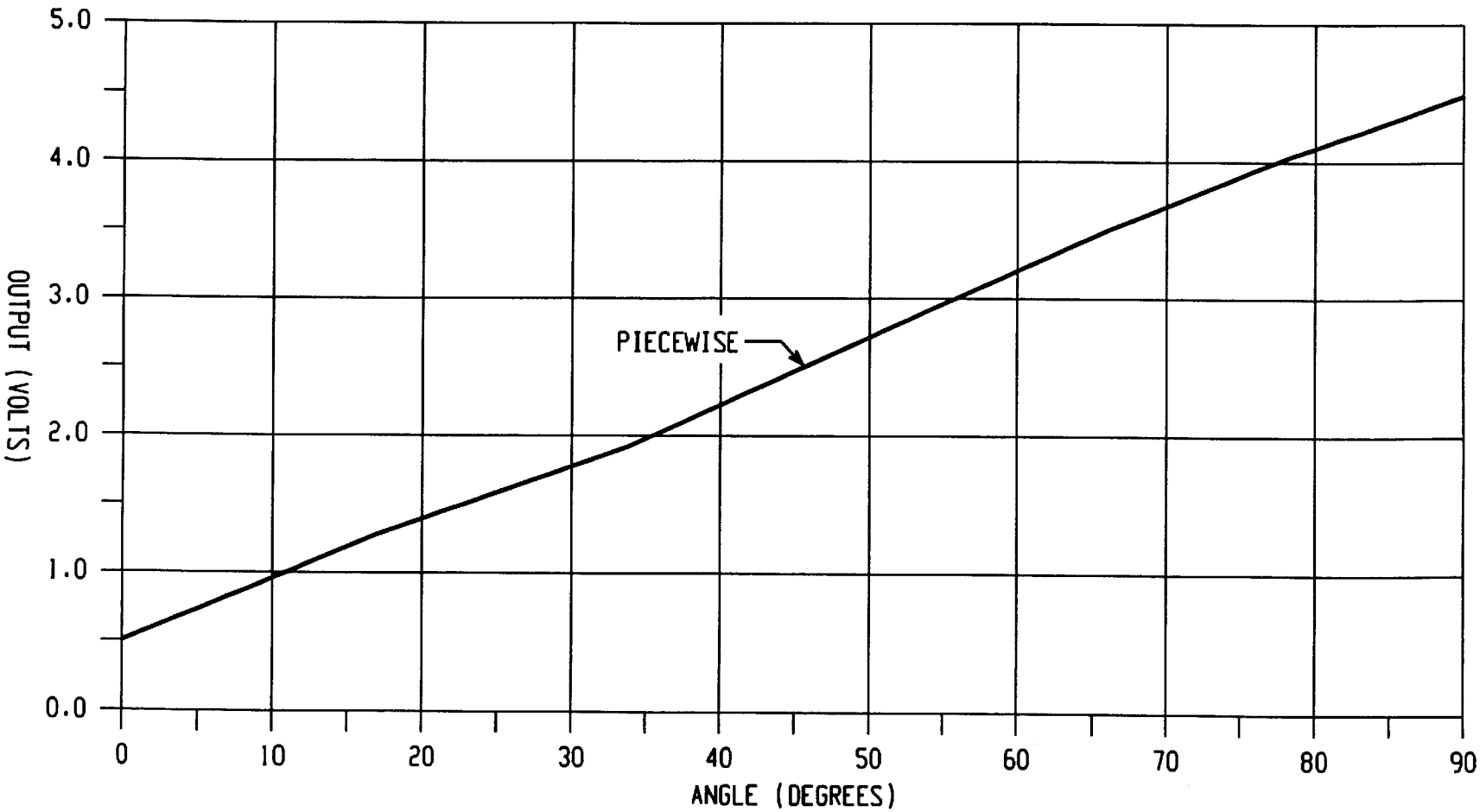
FIG. 6 is a plot of voltage versus angle of rotation for the output voltage of the present invention and, FIG. 7 is a schematic of the processing circuitry for another embodiment of the invention.

The multiplexer 76 is programmed to provide an output signal in the form of a linearly increasing analog voltage such as shown in FIG. 6 with the voltage as a function of the angle θ formed by the magnet with the fixed reference. The multiplexer 76 provides the voltage output of FIG. 6 by selecting the linear portion of the sine and cosine voltage waves of the sensor in accordance with the schedule of Table I.

TABLE I

| Θ | V |
|---|---|
| 0–22.5° | $A \text{ SIN}2\Theta + K_1$ |
| 22.5°–67.5° | $-B \text{ COS}2\Theta + K_2$ |
| 67.5°–112.5° | $-A \text{ SIN}2\Theta + K_3$ |
| 112.5°–157.5° | $B \text{ COS}2\Theta + K_4$ |
| 157.5°–180° | $A \text{ SIN}2\Theta + K_1$ |

The multiplexer 76 segments and provides the output voltage according to FIG. 6 by combining the voltage wave forms of Table I in accordance with the logic of Table II.

TABLE II

| V = | $S_3$ | $S_2$ | $S_1$ | $S_0$ | FIG. 5 Input Pin |
|---|---|---|---|---|---|
| $A \text{ SIN}2\Theta + K_1$ | 1 | — | 1 | 1 | 73 |
| $-B \text{ COS}2\Theta + K_2$ | — | 1 | 0 | 1 | 75 |
| $-A \text{ SIN}2\Theta + K_3$ | 0 | — | 0 | 0 | 77 |
| $B \text{ COS}2\Theta + K_4$ | — | 0 | 1 | 0 | 79 |

Where $S_3$, $S_2$, $S_1$ and $S_0$ are designated select inputs of the multiplexer 76 as follows: $S_3$=COS 2θ positive, $S_2$=SIN 2θ positive, $S_1$=COS 2θ>SIN 2θ and $S_0$=COS 2θ>−SIN 2θ.

Figure 7:
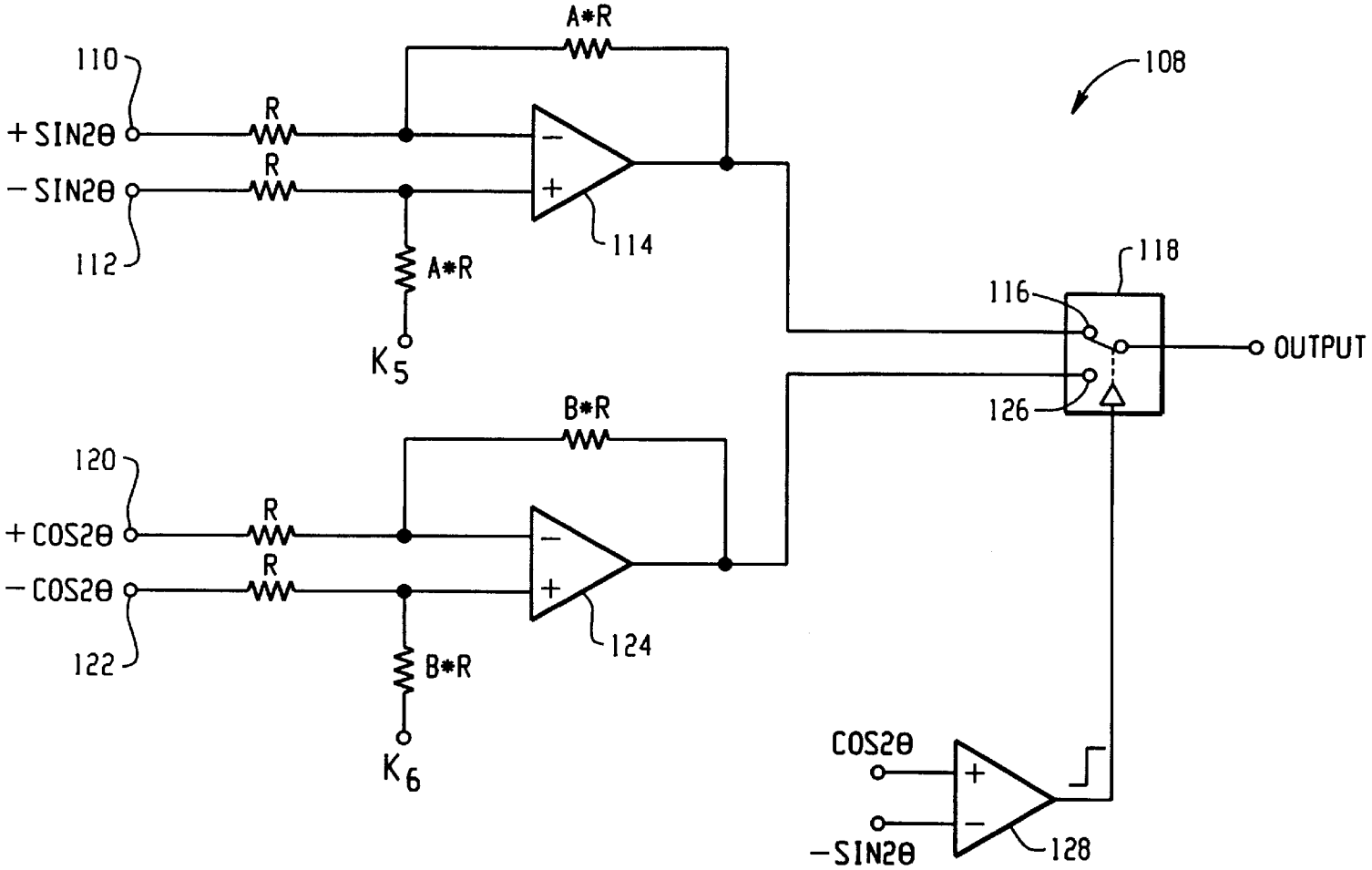

Referring to FIG. 7, an alternate embodiment of the circuit schematic of the present invention is indicated generally at 108 for a simplified sensor arrangement intended for sensing movement of an object relative to the sensor having an angular bearing from zero to 90°.

A sine 2θ voltage wave form from any of the sensors 22, 42, 60 is applied at terminals 110, 112 through resistor R to the inputs of an amplifier 114 with the positive terminal of the amplifier also receiving a reference voltage $K_5$ through a resistor A*R. The output of amplifier 114 is fed back to the negative input through a resistor A*R and is applied to one side terminal 116 of a switch indicated generally at 118.

The voltage wave form comprising CO2θ is applied to the input terminals 120, 122 of which are each connected through a resistor R to an input of amplifier 124. The positive terminal of amplifier 124 also receives the voltage $K_6$ through resistor B*R. The output of the amplifier 124 is fed back through a resistor B*R to the negative input terminal by the amplifier. The output of amplifier 124 is applied to a second side terminal 126 of the switch 118. The moveable or common terminal of the switch 118 is the output and is controlled by the output of amplifier 128 which has its positive input receiving the wave form CO2θ and its negative input receiving the wave form −SIN 2θ.

The strategy for the measurements of the embodiment of FIG. 7 is shown in Table III hereinbelow.

TABLE III

| Condition | Angle | Waveform Segment |
|---|---|---|
| $\text{COS}2\Theta \geqq -\text{SIN}2\Theta$ | 22.5° to 67.5° | $-B \text{ COS}2\Theta + K_6$ |
| $\text{COS}2\Theta \leqq -\text{SIN}2\Theta$ | 67.5° to 112.5° | $-A \text{ SIN}2\Theta + K_5$ |

It will be understood that A and B shall be chosen to provide the desired output voltage span over the range of the operating angle θ. In the present practice of the invention, A and B have been chosen such that the linear output spans from 0 to 5 volts over the angle range O to 180°. It will be apparent that other values may be used.

It will be further understood that the constants $K_1$ to $K_6$ shall be chosen such that when the substantially linear segments are pieced together, there is a smooth and continuous linear output voltage without steps at each connecting segment.

The present invention thus provides a simple and relatively low cost method of converting the sine and cosine voltage wave forms of a rotary position sensor to an analog signal varying linearly with respect to the position angle of an object moving with respect to the sensor.

Although the invention has hereinabove been described with respect to the illustrated embodiments, it will be understood that the invention is capable of modification and variation and is limited only by the following claims.

What is claimed is:

1. A method of providing an analog electrical signal indicative of the position of a moving object comprising:

(a) disposing a magnet for movement with the object;

(b) disposing a stationary sensor in a position to be proximate the moving object and electrically exciting the sensor with substantially constant direct current voltage;

(c) generating a sine wave voltage signal and a cosine wave signal with the sensor as the object is moved with respect to the sensor;

(d) inputting said sine and cosine signal to an amplifier means and multiplexer means and outputting a voltage signal with said sensor according to the following table, where θ represents the instantaneous included angle of rotation of the magnet relative to a reference:

| Θ | V |
|---|---|
| 0–22.5° | A SIN2Θ + $K_1$ |
| 22.5°–67.5° | −B COS2Θ + $K_2$ |
| 67.5°–112.5° | −A SIN2Θ + $K_3$ |
| 112.5°–157.5° | B COS2Θ + $K_4$ |
| 157.5°–180° | A SIN2Θ + $K_1$. |

2. The method defined in claim 1 wherein said step of disposing a magnet for movement includes disposing a magnet for curvilinear movement with respect to the sensor.

3. The method defined in claim 1 wherein said step of disposing a magnet for movement includes disposing a magnet for orbital movement about the sensor.

4. The method defined in claim 1 wherein said step of disposing a magnet for movement includes rotating the magnet with respect to the sensor about an axis passing through the magnet.

5. A method of providing an analog electrical signal indicative of the position of a moving object comprising:

(a) disposing a magnet for movement with the object;

(b) disposing a stationary sensor in a position to be proximate the moving object and electrically exciting the sensor with a substantially constant direct current voltage;

(c) generating a sine wave voltage signal and a cosine wave voltage signal with the sensor as the object is moved with respect to the sensor;

(d) inputting said sine and cosine voltage signals to an amplifier means and multiplexer means and outputting a voltage signal according to the following table:

| V = | $S_3$ | $S_2$ | $S_1$ | $S_0$ | |
|---|---|---|---|---|---|
| A SIN2Θ + $K_1$ | 1 | — | 1 | 1 | where: $S_3$ = COS2Θ =+ (or greater than a chosen reference) |
| −B COS2Θ + $K_2$ | — | 1 | 0 | 1 | where: $S_2$ = SIN2Θ =+ (or greater than a chosen reference) |
| −A SIN2Θ + $K_3$ | 0 | — | 0 | 0 | where: $S_1$ = COS2Θ > SIN2Θ |
| B COS2Θ + $K_4$ | — | 0 | 1 | 0 | where: $S_0$ = COS2Θ > −SIN2Θ. |

6. A method of providing an analog electrical signal indicative of the position of a moving object comprising:

(a) disposing a magnet for movement with the object;

(b) disposing a stationary sensor in a position to be proximate the moving object and electrically exciting the sensor with substantially constant direct current voltage;

(c) generating a sine wave voltage signal and a cosine wave signal with the sensor as the object is moved with respect to the sensor;

(d) inputting said sine and cosine signal to an amplifier means and a comparator means, and outputting a voltage signal with the sensors according to the following table, where θ represents the instantaneous included angle of rotation of the magnet relative to a reference:

| Θ | Condition | V |
|---|---|---|
| 22.5° to 67.5° | COS2Θ ≧ −SIN2Θ | −B COS2Θ + $K_6$ |
| 67.5° to 112.5° | COS2Θ ≦ −SIN2Θ | −A SIN2Θ + $K_5$. |

7. The method defined in claim 6, wherein the step of inputting the sine and cosine signal to a comparator means includes inputting the output of the said comparator means to one side of a switch and moving said switch.

8. The method defined in claim 7, wherein the step of changing the state of said switch includes moving said switch in response to whether the cosine signal is greater than or less than the sine signal.

* * * * *